US011732551B1

(12) United States Patent
Tang et al.

(10) Patent No.: US 11,732,551 B1
(45) Date of Patent: Aug. 22, 2023

(54) FULLY ELECTRICALLY CONTROLLED INTELLIGENT SUBSURFACE SAFETY VALVE

(71) Applicant: Southwest Petroleum University, Chengdu (CN)

(72) Inventors: Yang Tang, Chengdu (CN); Na Xie, Chengdu (CN); Minghai Zhou, Chengdu (CN); Jinhai Zhao, Beijing (CN); Guangjie Yuan, Beijing (CN); Guohai Yuan, Beijing (CN); Jinzhong Wang, Tangshan (CN); Chenglin Wang, Shanghai (CN); Xiang Gao, Beijing (CN); Guorong Wang, Chengdu (CN); Fu Deng, Deyang (CN); Liming Fan, Deyang (CN); Rutao Ma, Beijing (CN)

(73) Assignee: Southwest Petroleum University, Chengdu (CN)

( * ) Notice: Subject to any disclaimer, the term of this patent is extended or adjusted under 35 U.S.C. 154(b) by 0 days.

(21) Appl. No.: 18/306,270

(22) Filed: Apr. 25, 2023

(30) Foreign Application Priority Data

May 18, 2022 (CN) ..... 202210550541.6

(51) Int. Cl.
*E21B 34/06* (2006.01)
*E21B 34/14* (2006.01)

(52) U.S. Cl.
CPC ..... *E21B 34/066* (2013.01); *E21B 34/14* (2013.01); *E21B 2200/05* (2020.05)

(58) Field of Classification Search
CPC .... E21B 34/066; E21B 34/14; E21B 2200/05; E21B 34/06
See application file for complete search history.

(56) References Cited

U.S. PATENT DOCUMENTS 11,111,779 B2 * 9/2021 Inglis ..... E21B 23/004
11,293,278 B2 * 4/2022 Joseph ..... F16K 37/0041
(Continued)

FOREIGN PATENT DOCUMENTS

CN 106246137 A 12/2016
CN 206205857 U 5/2017
(Continued)

OTHER PUBLICATIONS

Zhou Dawei et al., "technical status and development trend of downhole safety valves at home and abroad", Oil Field Equipment, Mar. 28, 2007, vol. 36, No. 3, pp. 14-16.

*Primary Examiner* — Daniel P Stephenson

(57) ABSTRACT

A fully electrically controlled intelligent subsurface safety valve is provided, including an upper joint, a lower joint, a magnetic switch, an upper electromagnetic suction module, a central flow pipe, a magnetic piston ring, a lower electromagnetic suction module, a rebound flap valve mechanism, a displacement sensor, a temperature and pressure sensor, a flow sensor, and a power communication composite cable connector. With the magnetic assisted reset of the two electromagnetic suction modules, the safety valve closes more quickly in emergency situations, improving the reliability of the safety valve. By using a magnetic excitation switch, the safety valve can be quickly opened and closed, and the open or close state can be maintained independently, saving energy consumption in the control system. The present disclosure can better meet the needs of onshore and offshore oil and gas production operations and gas storage operations.

8 Claims, 8 Drawing Sheets

(56) References Cited

U.S. PATENT DOCUMENTS

| | | | | |
|---|---|---|---|---|
| 2015/0300124 | A1 | 10/2015 | Mailand et al. | |
| 2019/0170269 | A1* | 6/2019 | Oulton | E21B 23/004 |
| 2020/0032616 | A1* | 1/2020 | Vick, Jr. | E21B 34/16 |
| 2020/0308929 | A1 | 10/2020 | Eriksen | |
| 2020/0370394 | A1* | 11/2020 | Cai | E21B 34/066 |
| 2021/0115759 | A1* | 4/2021 | Ng | E21B 34/12 |
| 2023/0018892 | A1* | 1/2023 | Chouzenoux | E21B 34/066 |

FOREIGN PATENT DOCUMENTS

| | | | | |
|---|---|---|---|---|
| CN | 110005371 | A | | 7/2019 |
| CN | 110424925 | A | | 11/2019 |
| CN | 111425164 | A | | 7/2020 |
| CN | 111577201 | A | | 8/2020 |
| CN | 111706295 | A | | 9/2020 |
| CN | 112412396 | A | | 2/2021 |
| CN | 113027380 | A | | 6/2021 |
| CN | 114961642 | A | * | 8/2022 |
| WO | 2021173684 | A1 | | 9/2021 |

* cited by examiner closing of the safety valve opening of the safety valve

FULLY ELECTRICALLY CONTROLLED INTELLIGENT SUBSURFACE SAFETY VALVE

CROSS-REFERENCE TO RELATED APPLICATIONS

This application claims priority to Chinese Application No. 202210550541.6, filed on May 18, 2022, entitled "FULLY ELECTRICALLY CONTROLLED INTELLIGENT SUBSURFACE SAFETY VALVE". These contents are hereby incorporated by reference.

TECHNICAL FIELD

The present disclosure relates to the field of petroleum engineering, in particular to a fully electrically controlled intelligent subsurface safety valve.

BACKGROUND

Subsurface safety valve is a downhole tool installed in an oil and gas well that can be shut down urgently to prevent blowout, ensure oil and gas well measures, and ensure production safety in the event of a fire alarm, pipeline rupture, or irresistible natural disasters (such as earthquakes, ice conditions, strong typhoons, etc.) in production facilities. In onshore and offshore oil and gas production operations, as well as gas storage operations, downhole safety valves are essential tools. Currently, almost all subsurface safety valves are hydraulically controlled. When the safety valve is opened, the surface hydraulic control system injects high-pressure liquid into the control pipeline, causing the safety valve plate valve to open under the indirect push of the piston, maintaining the high pressure in the pipeline, and keeping the safety valve in a stable open state; When an emergency occurs and it is necessary to close the fluid channel, the surface hydraulic control system releases the high pressure in the pipeline, the safety valve plate valve is closed under the action of spring force, and the fluid channel is closed.

However, as oil and gas exploration and development areas enter deeper depths, the opening and closing response time of the safety valve has a certain lag for a long-distance hydraulic pipeline control, and the installation depth of the safety valve is limited, making it difficult to meet ultra-deep installation requirements. In addition, the hydraulic oil is easy to leak, and its own compressibility will cause pipeline deformation after a long time. The hydraulic operation procedure is relatively complex, and it is difficult to maintain the stability of load movement speed when the environment changes sharply, besides, the pollution of hydraulic oil may even lead to failure of the hydraulic system. The flow of hydraulic oil in the pipeline will cause pressure loss, so with the pipeline is longer, the pressure loss is increased and the power transmission efficiency is reduced. Thus, hydraulic transmission is not suitable for remote control and transmission, thereby limiting the scope of subsurface safety valves, further, the hydraulic control response speed is slow, which is not conducive to achieving efficient control. Given these defects, some have proposed electrically controlled subsurface safety valves, but the existing electrically controlled subsurface safety valves generally have the following disadvantages:

I. The piston is the actuator of the existing subsurface safety valve, which is used to compress the spring to push the center pipe to open the valve plate, due to the large diameter and mass of the piston, the spring needs to overcome the piston gravity during the valve plate closing process. Therefore, when the piston gravity is too large, the safety valve closes slowly or even cannot close normally if only relying on the restoring force of spring to overcome the piston gravity.

2. The existing subsurface safety valves have complex structures, sluggish transmission, cumbersome operating procedures, and high energy consumption in the control system. Moreover, the cost is high and the economic benefits are low, when hazardous conditions occur, the closing of the safety valve cannot be easily and quickly completed.

3. The existing electronic magnetic coupling device has a slow coupling speed. When the piston thrust is too large, the attraction between the magnetic rings cannot be maintained, and the inner and outer magnetic rings will disengage, causing failure opening of the safety valve.

4. With the increasing difficulty of oil and gas field development, special well structures are becoming more and more common. Existing surface safety valves cannot provide a more intelligent and flexible way to control, resulting in lower crude oil recovery rate, high equipment maintenance costs, and short service life.

SUMMARY

For the problems existing in the application of existing similar structures and functional devices, a fully electrically controlled intelligent subsurface safety valve is provided by the present disclosure. Under the magnetic assisted reset of the upper electromagnetic suction module and the lower electromagnetic suction module, the safety valve can be closed more quickly in emergency situations, which can quickly cut off production channels, solving problems such as slow closing or abnormal closing of the safety valve. The use of magnetic excitation switches can quickly achieve the opening and closing of the safety valve, and independently maintain the opening and closing state, saving energy consumption in the control system, solving problems such as cumbersome operating procedures for the safety valve. The use of direct electronically controlled magnetic suction solves problems such as the limited depth of the safety valve, and overcomes defects such as "miss target" of the magnetic coupling device when the piston thrust is too large. By using multiple types of sensors to enhance the fully electronically and intelligent control of safety valves, real-time monitoring and control of safety valve parameters have been achieved, so as to reduce the risk of safety valve failure, improve work safety, and lower overall work costs.

A fully electrically controlled intelligent subsurface safety valve, including an external component, a magnetic excitation switch, an upper electromagnetic suction module, a lower electromagnetic suction module, and a rebound flap valve mechanism, wherein the external component is composed of an upper joint, a lower joint, a valve shell, a flow sensor, a power communication composite cable connector, a sealing cover, a PLC controller, and a temperature and pressure sensor; the magnetic switch is composed of a magnetic piston ring, a spring, a thrust bearing, a central flow tube, a guide sleeve and a locking sleeve; the upper electromagnetic suction module and the lower electromagnetic suction module are both composed of a magnetic isolation collar, an annular wire rack, a annular iron core, a circular coil, and an outer sleeve; and the rebound flap valve mechanism is composed of a valve seat, a plate valve, and a displacement sensor; wherein the upper joint is connected to the valve shell through threads, the valve shell is provided with a first valve shell through hole, a second valve shell through hole, a first step, and a second step; the central flow pipe is arranged between the upper joint and the plate valve, the locking sleeve is connected to the upper joint through threads, the guide sleeve is arranged between the locking sleeve and the central flow pipe, the upper electromagnetic suction module is arranged between the upper joint and the first step, the magnetic piston ring is connected with the central flow pipe through threads, the magnetic piston ring is matched with the valve shell in a clearance fit, the spring is arranged between the central flow pipe and the valve seat, the lower electromagnetic suction module is arranged between the second step and the valve seat, the valve seat is connected with the valve shell through threads, the lower joint is connected with the valve shell through threads, the displacement sensor is provided on the plate valve, the flow sensor is provided on an inner wall of the lower joint, and the temperature and pressure sensor is arranged inside the lower joint.

A plurality of first electrical connection holes are circumferentially distributed on an upper end of the upper joint uniformly, the power communication composite cable connector is arranged in the first electrical connection holes, and the upper electromagnetic suction module, the lower electromagnetic suction module, the displacement sensor, the flow sensor, and the temperature and pressure sensor are all electrically connected through the power communication composite cable connector.

An inner wall of the upper joint is provided with a guide groove, a first through hole, and a first groove, the PLC controller is arranged in the first groove and a power supply line of the PLC controller passes through the first through hole, and the sealing cover is covered and arranged on the upper joint through the guide groove.

A second electrical connection hole, a first sealing groove, and a second through hole are circumferentially distributed at the lower end of the lower joint uniformly, a power supply line of the displacement sensor passes through the second through hole, and a plurality of the flow sensors are arranged circumferentially on the inner wall of the lower joint uniformly.

Power supply lines of the upper electromagnetic suction module and the lower electromagnetic suction module respectively pass through the first valve shell through hole and the second valve shell through hole.

An upper part of the central flow pipe is provided with a second sealing groove, a middle part is circumferentially distributed with protrusions and inclined slots uniformly, and a lower part is provided with a third step.

The guide sleeve is provided with guide inclined surfaces, guide blocks, and a second groove, and the thrust bearing is arranged in the second groove.

The locking sleeve is provided with locking inclined surfaces and sliding slots.

It should be further known that the technical features corresponding to the above description can be combined or replaced to form a new technical solution.

Compared with the prior art, the advantageous effects of the present disclosure are as following:

1. With the magnetic assistance reset of two electromagnetic suction modules, the safety valve can close and respond faster in emergency situations, and can quickly cut off the production channel.

2. By using a magnetic excitation switch, the safety valve can be quickly opened and closed, and the open or close state can be maintained independently, saving energy consumption in the control system and solving problems such as cumbersome safety valve operation procedures.

3. The use of direct electronically controlled magnetic suction solves problems such as the limited depth of the safety valve, and overcomes defects such as "miss target" of the magnetic coupling device when the piston thrust is too large, greatly improving the reliability of the subsurface safety valve.

4. By using multiple types of sensors to enhance the fully electronically and intelligent control of safety valves, real-time monitoring and control of safety valve parameters have been achieved, so as to reduce the risk of safety valve failure, improve work safety, and lower overall work costs.

BRIEF DESCRIPTION OF DRAWINGS

The specific embodiments of the present disclosure are described in further detail below in conjunction with the accompanying drawings, which are used to provide a further understanding of the application and form a part of the application. The same reference numerals are used in these drawings to represent the same or similar components. The illustrative embodiments and descriptions of the application are used to explain the application and do not constitute an improper limitation of the application.

Figure 1:
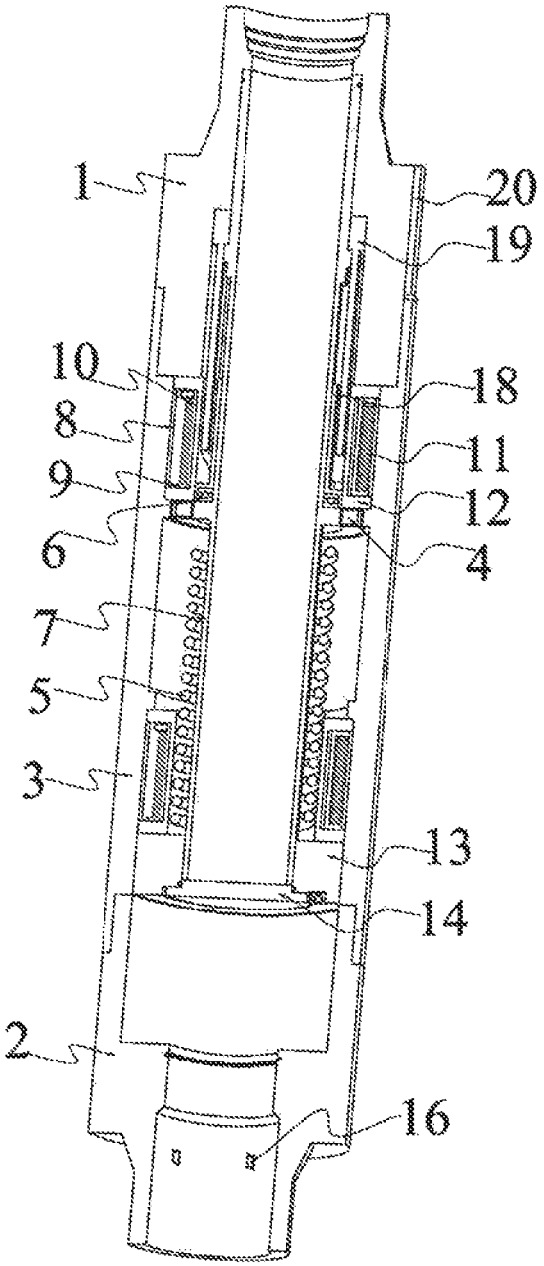
FIG. 1 is a sectional view of the a fully electrically controlled intelligent subsurface safety valve of the present disclosure.

Reference numbers in the figures: 1. upper joint; 2. lower joint; 3. valve shell; 4. magnetic piston ring; 5. spring; 6. thrust bearing; 7. central flow pipe; 8. magnetic isolation collar; 9. annular wire rack; 10. annular iron core; 11. circular coil; 12. outer sleeve; 13. valve seat; 14. plate valve; 15. displacement sensor; 16. flow sensor; 17. power communication composite cable connector; 18. guide sleeve; 19. locking sleeve; 20. sealing cover; 21. PLC controller; 22. temperature and pressure sensor; 101. first electrical connection hole; 102. guide groove; 103. first through hole; 104. first groove; 201. second electrical connection hole; 202. first sealing groove; 203. second through hole; 301. first valve shell through hole; 302. second valve shell through hole; 303. first step; 304. second step; 701. second sealing groove; 702. protrusion; 703. inclined slot; 704. third step; 1801. guide inclined surface; 1802. guide block; 1803. second groove; 1901. locking inclined surface; 1902. sliding slot.

DETAILED DESCRIPTION OF PREFERRED EMBODIMENTS

In order to better understand the objectives, features, and advantages of the present invention, the present invention is described below in further detail with reference to the accompanying drawings and specific implementations. It should be noted that without a conflict, the embodiments of this application and the features in the embodiments may be combined with each other.

Many specific details are set forth in the following description to facilitate a full understanding of the present invention. However, the present invention may be implemented in other manners other than those described herein. Therefore, the protection scope of the present invention is not limited by the specific embodiments disclosed below.

In the present invention, the terms "first," "second," "third", and "fourth" are merely for the purpose of description, but cannot be understood as indicating or implying relative importance. The term "multiple" means two or more unless otherwise explicitly defined. The terms "mount," "connect with," "connect," "fix," and the like shall be understood in a broad sense.

For example, "connect" may mean being fixedly connected, detachably connected, or integrally connected; and "connect with" may mean being directly connected or indirectly connected through an intermediary. For those of ordinary skill in the art, specific meanings of the above terms in the present invention can be understood according to specific situations.

In the description of the present invention, it should be understood that if orientation or position relations indicated by the terms such as "upper," "lower," "left," "right," "front," "back," "vertical", "horizontal", "inside", "outside" and the like are based on the orientation or position relations shown in the drawings, and the terms are intended only to facilitate the description of the present invention and simplify the description, rather than indicating or implying that the apparatus or element referred to must have a particular orientation and be constructed and operated in the particular orientation, and therefore cannot be construed as a limitation on the present invention.

Figure 2:
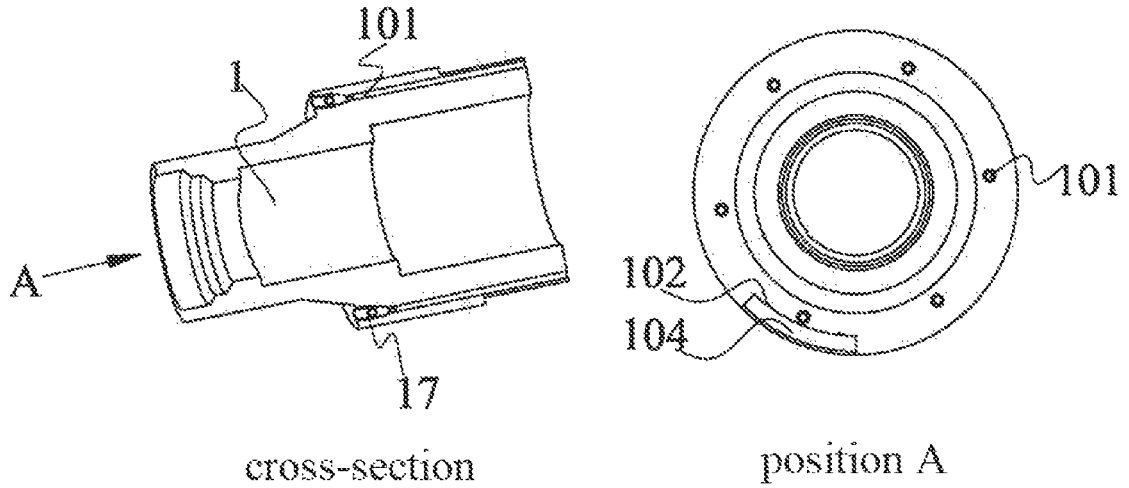
FIG. 2 is a perspective cross-sectional view of the upper joint of the present disclosure.
Figure 3:
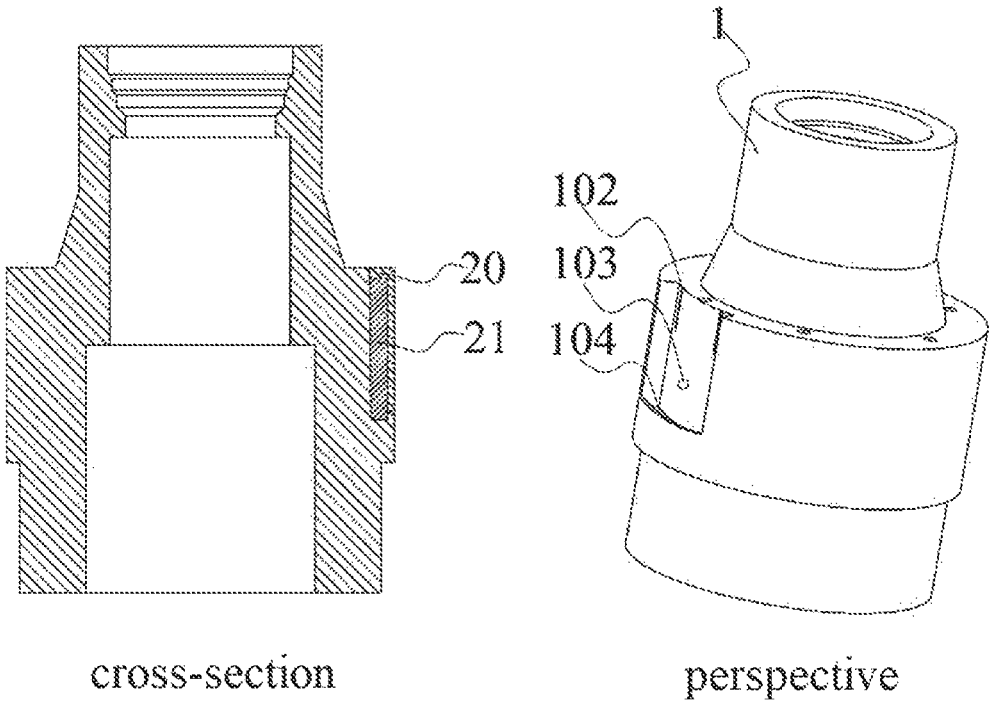
FIG. 3 is a cross-sectional and three-dimensional view of the upper joint of the present disclosure.
Figure 4:
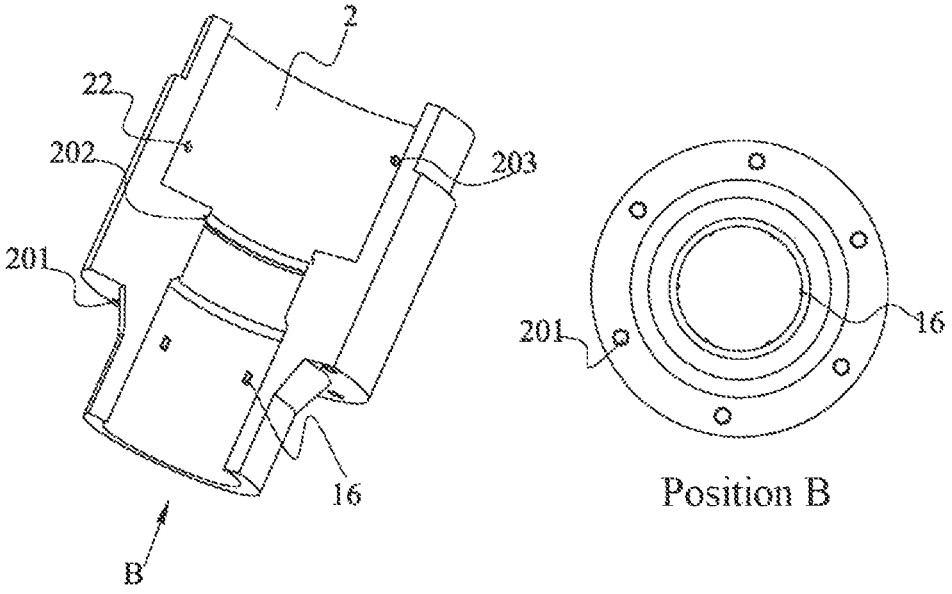
FIG. 4 is a perspective cross-sectional view of the lower joint of the present disclosure.
Figure 5:
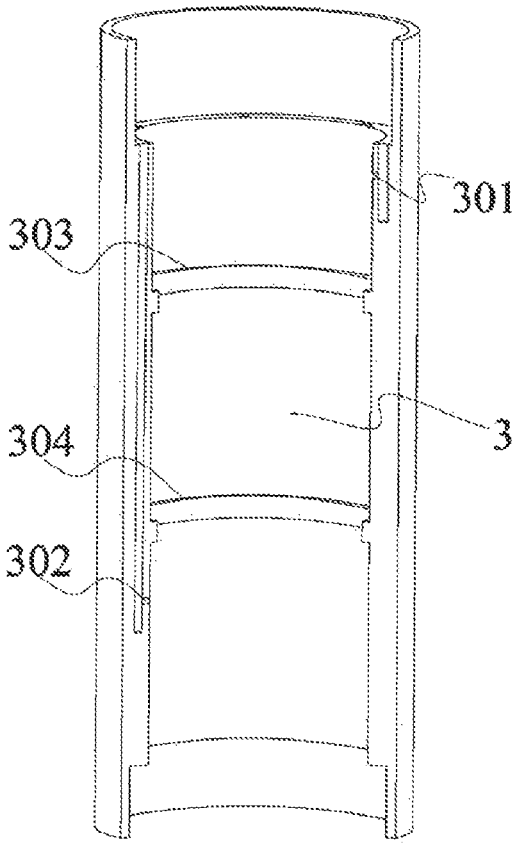
FIG. 5 is a perspective cross-sectional view of the valve shell of the present disclosure.
Figure 6:
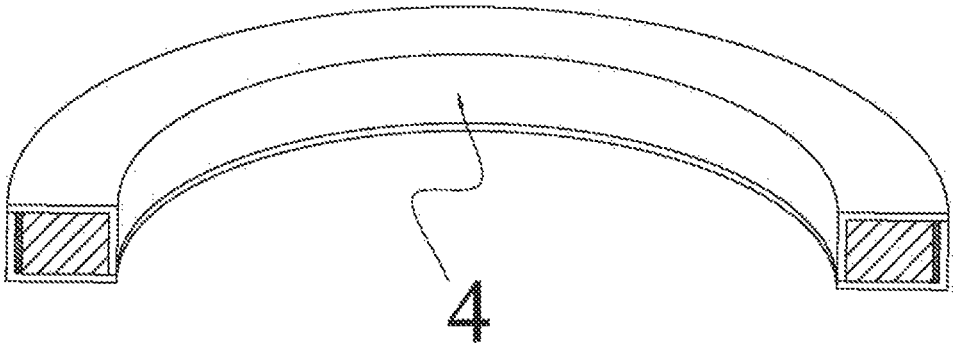
FIG. 6 is a perspective cross-sectional view of the magnetic piston ring of the present disclosure.
Figure 7:
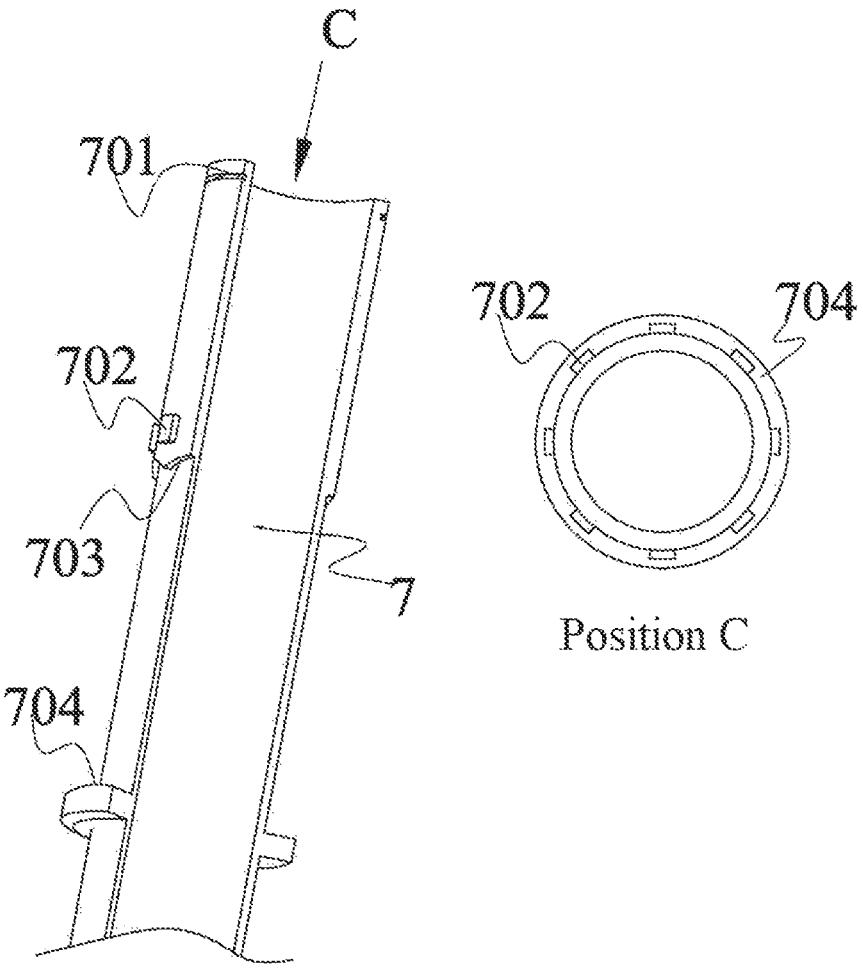
FIG. 7 is a perspective cross-sectional view of the central flow pipe of the present disclosure.
Figure 8:
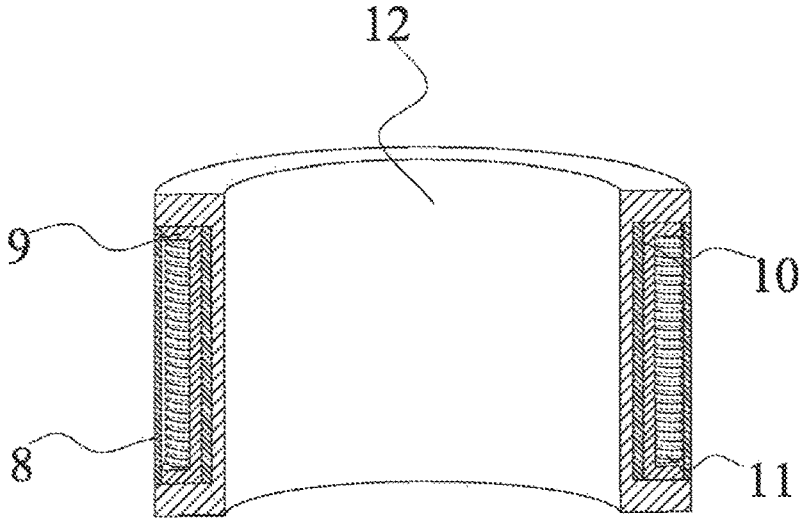
FIG. 8 is a perspective cross-sectional view of the upper electromagnetic suction module or the lower electromagnetic suction module of the present disclosure.
Figure 9:
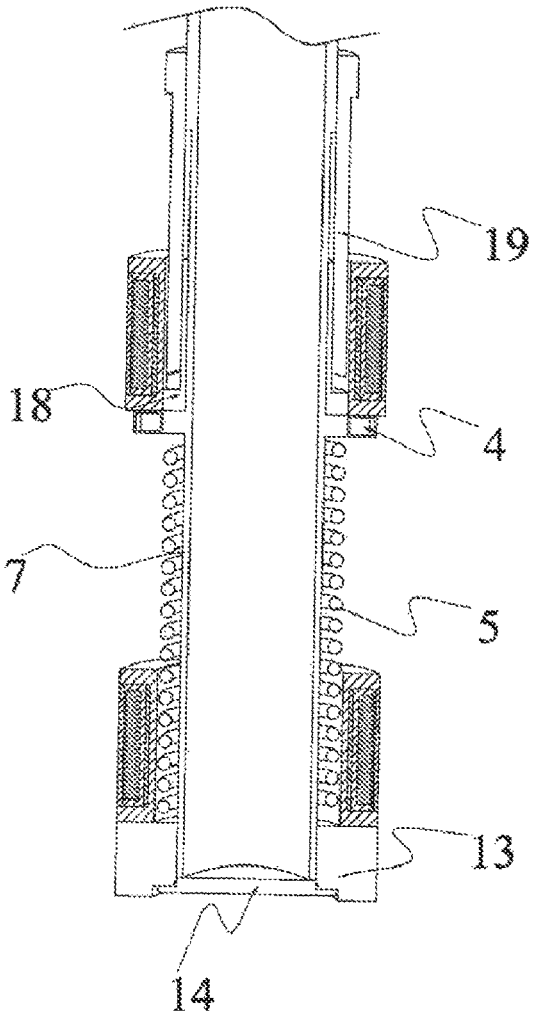
FIG. 9 is a cross-sectional view showing of the axial distribution of the upper electromagnetic suction module and the lower electromagnetic suction module of the present disclosure.
Figure 10:
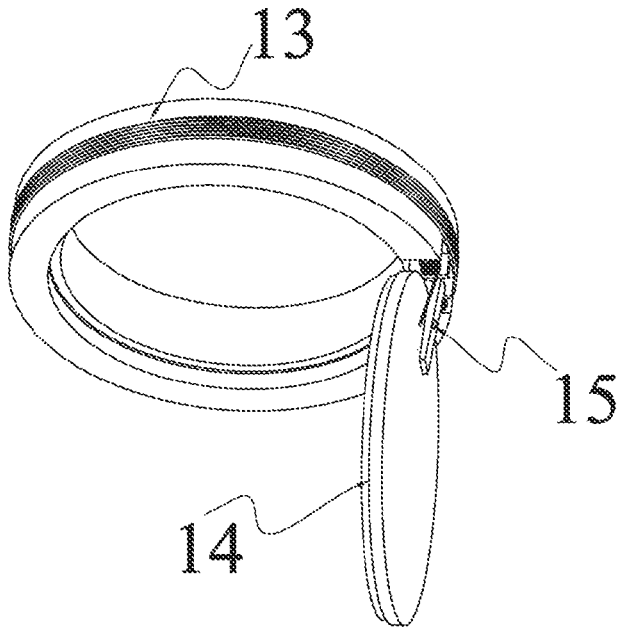
FIG. 10 is a perspective view of the rebound flap valve mechanism of the present disclosure.
Figure 11:
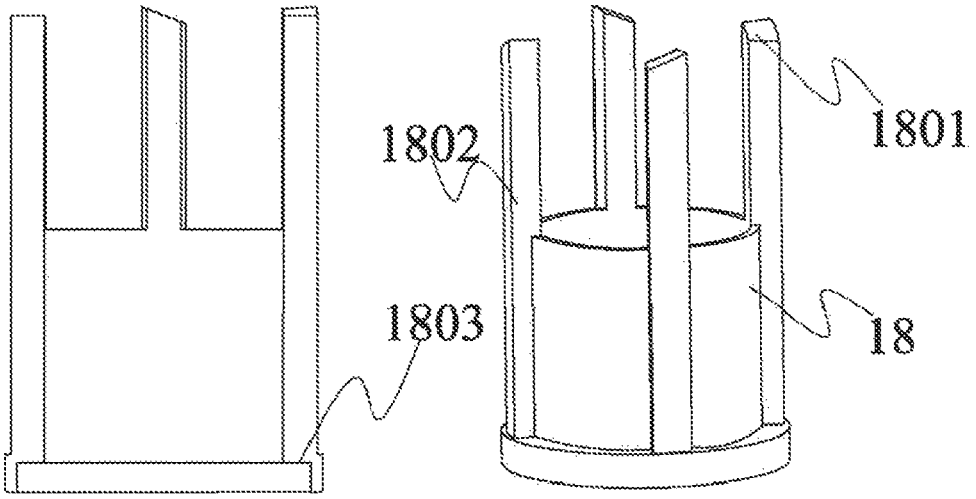
FIG. 11 is a perspective view of the guide sleeve of the present disclosure.
Figure 12:
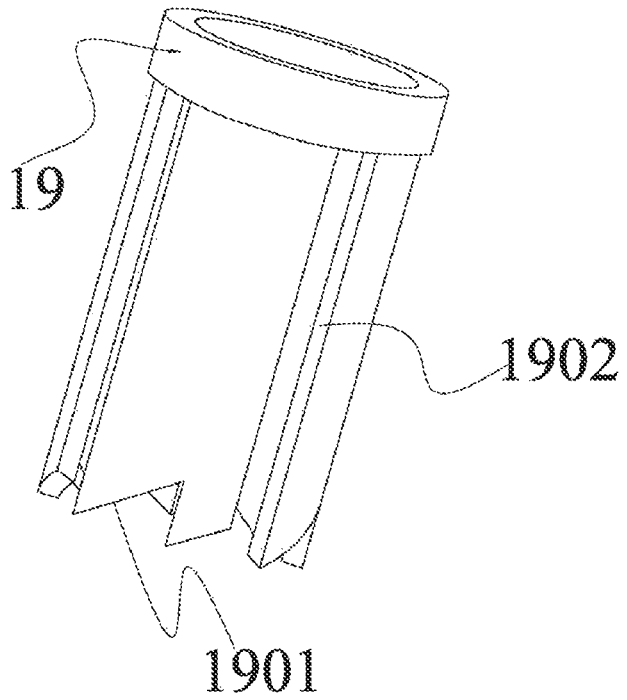
FIG. 12 is a perspective view of the locking sleeve of the present disclosure.
Figure 13:
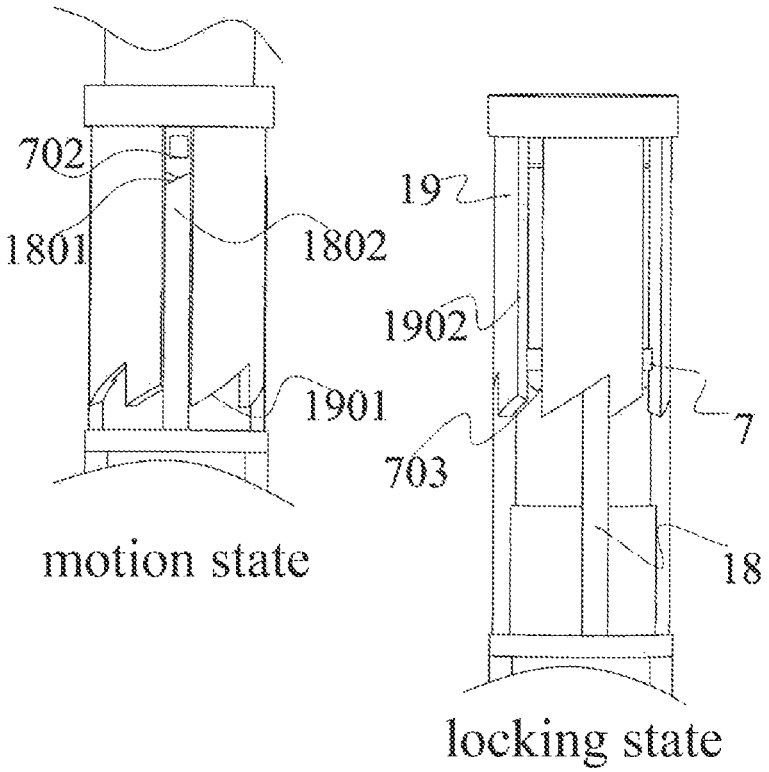
FIG. 13 is a perspective view of the motion and locking states of the magnetic excitation switch of the present disclosure.
Figure 14:
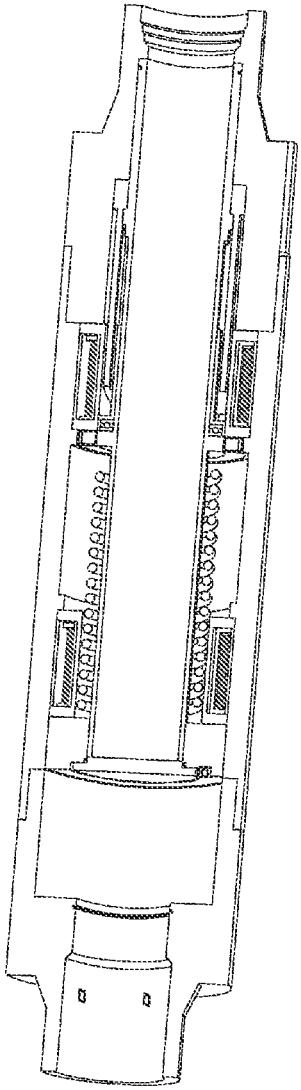
FIG. 14 is a perspective cross-sectional view of the closed and open states of the safety valve of the present disclosure.
Figure 14:
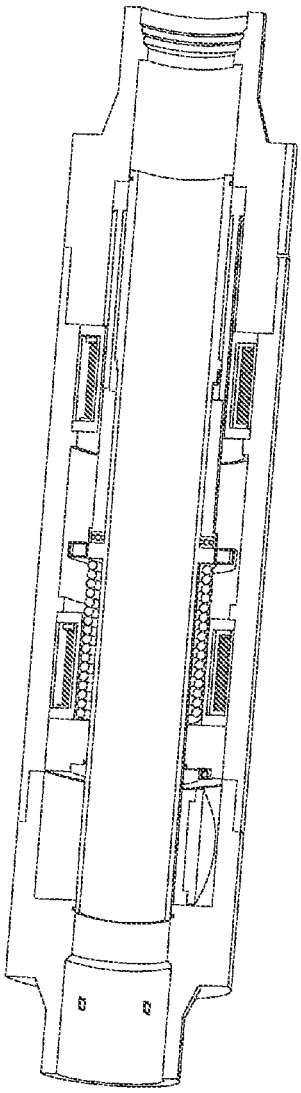

As shown in FIG. 1 to FIG. 14, a fully electrically controlled intelligent subsurface safety valve is provided, which includes an external component, a magnetic excitation switch, an upper electromagnetic suction module, a lower electromagnetic suction module, and a rebound flap valve mechanism. The external component is composed of an upper joint 1, a lower joint 2, a valve shell 3, a flow sensor 16, a power communication composite cable connector 17, a sealing cover 20, a PLC controller 21, and a temperature and pressure sensor 22. The magnetic switch is composed of a magnetic piston ring 4, a spring 5, a thrust bearing 6, a central flow tube 7, a guide sleeve 18 and a locking sleeve 19. The upper electromagnetic suction module and the lower electromagnetic suction module are both composed of a magnetic isolation collar 8, an annular wire rack 9, a annular iron core 10, a circular coil 11, and an outer sleeve 12. The rebound flap valve mechanism is composed of a valve seat 13, a plate valve 14, and a displacement sensor 15. The upper joint 1 is connected to the valve shell 3 through threads, the valve shell 3 is provided with a first valve shell through hole 301, a second valve shell through hole 302, a first step 303, and a second step 304. The central flow pipe 7 is arranged between the upper joint 1 and the plate valve 14, the locking sleeve 19 is connected to the upper joint 1 through threads, the guide sleeve 18 is arranged between the locking sleeve 19 and the central flow pipe 7, and the upper electromagnetic suction module is arranged between the upper joint 1 and the first step 303. The magnetic piston ring 4 is connected with the central flow pipe 7 through threads, the magnetic piston ring 4 is matched with the valve shell 3 in a clearance fit, the spring 5 is arranged between the central flow pipe 7 and the valve seat 13, the lower electromagnetic suction module is arranged between the second step 304 and the valve seat 13, the valve seat 13 is connected with the valve shell 3 through threads, the lower joint 2 is connected with the valve shell 3 through threads, the displacement sensor 15 is provided on the plate valve 14, the flow sensor 16 is provided on an inner wall of the lower joint 2, and the temperature and pressure sensor 22 is arranged inside the lower joint 2.

A plurality of first electrical connection holes 101 are circumferentially distributed on an upper end of the upper joint 1 uniformly, the power communication composite cable connector 17 is arranged in the first electrical connection holes 101, and the upper electromagnetic suction module, the lower electromagnetic suction module, the displacement sensor 15, the flow sensor 16, and the temperature and pressure sensor 22 are all electrically connected through the power communication composite cable connector 17.

An inner wall of the upper joint 1 is provided with a guide groove 102, a first through hole 103, and a first groove 104, the PLC controller 21 is arranged in the first groove 104 and a power supply line of the PLC controller passes through the first through hole 103, and the sealing cover 20 is covered and arranged on the upper joint 1 through the guide groove 102.

It can be understood that the cable enters along with the pipe string, which can provide both underground power supply and signal transmission.

Specifically, the displacement sensor 15, the flow sensor 16, and the temperature and pressure sensor 22 can process, analyze, and control signals such as the opening and closing position of plate valve 14, downhole temperature, pressure, and flow rate at any time through the PLC controller 21, and transmit the monitoring results in real-time to the wellhead for easy recording and operation, and transmit them to the main control center through networking.

A second electrical connection hole 201, a first sealing groove 202, and a second through hole 203 are circumferentially distributed at the lower end of the lower joint 2 uniformly, a power supply line of the displacement sensor 15 passes through the second through hole 203, and a plurality of the flow sensors 16 are arranged circumferentially on the inner wall of the lower joint 2 uniformly.

It can be understood that there is a second electrical connection hole 201 arranged on the lower joint 2, which can supply power to the equipment at the lower end of the pipe string.

Power supply lines of the upper electromagnetic suction module and the lower electromagnetic suction module respectively pass through the first valve shell through hole 301 and the second valve shell through hole 302.

It can be understood that the upper electromagnetic suction module and the lower electromagnetic suction module are both composed of the magnetic isolation collar 8, the annular wire rack 9, the annular iron core 10, the circular coil 11, and the outer sleeve 12. The magnetic piston ring 4 is located between the upper electromagnetic suction module and the lower electromagnetic suction module.

Specifically, the magnetic isolation collar 8 can shield the circumferential magnetic field, so that the upper electromagnetic suction module and the lower electromagnetic suction module only provide axial magnetic field. The upper electromagnetic suction module and the lower electromagnetic suction module are used to drive the center flow pipe 7 to slide, so as to open or close the plate valve 14. The two electromagnetic suction modules provide dual protection, ensuring normal operation even if one fails. The magnetic piston ring 4 is provided with a housing and a magnetic isolating ring. The housing can realize the easy installation and positioning of the magnetic piston ring 4, and ensure that the magnetic piston ring 4 is not easily damaged by collision. The magnetic isolating ring can shield the circumferential magnetic field force to ensure that the magnetic piston ring 4 only slides axially.

An upper part of the central flow pipe 7 is provided with a second sealing groove 701, a middle part is circumferentially distributed with protrusions 702 and inclined slots 703 uniformly, and a lower part is provided with a third step 704.

The guide sleeve 18 is provided with guide inclined surfaces 1801, guide blocks 1802, and a second groove 1803, and the thrust bearing 6 is arranged in the second groove 1803.

The locking sleeve 19 is provided with locking inclined surfaces 1901 and sliding slots 1902.

The working process of the present disclosure is as follows:

In normal operation, the upper electromagnetic suction module is used to generate the repulsive force to the magnetic piston ring 4, and the lower electromagnetic suction module is used to generate the magnetic suction force to the magnetic piston ring 4, so as to drive the central flow tube 7 to slide axially, at the same time, to overcome the preload of the spring 5 to drive the protrusion 702 on the central flow tube 7, so as to push the guide sleeve 18 to move axially. The guide block 1802 on the guide sleeve 18 moves axially away from the sliding slot 1902, the guide inclined surface 1801 drives the inclined slot 703 on the central flow tube 7 to move to the locking inclined surface 1901, and the thrust bearing 6 rotates at a certain angle with the movement of the guide sleeve 18. Finally, the guide inclined surface 1801 moves to the top of the locking inclined surface 1901, and at this time, the magnetic switch completes its action to achieve self-locking function. Since there is a preload when installing spring 5, the central flow pipe 7 and the guide sleeve 18 will not be pushed. At the same time, the central flow pipe 7 pushes open the plate valve 14, and the subsurface safety valve will remain open. The displacement sensor 15, the flow sensor 16, and the temperature and pressure sensor 22 can process, analyze, and control the opening and closing positions of the plate valve 14, underground temperature, pressure, flow rate, and other signals through the PLC controller 21 at any time, and the monitoring results in real-time will be transmitted to the main control center.

When the displacement sensor 15, the flow sensor 16, and the temperature and pressure sensor 22 detect dangerous working conditions such as well kick and blowout, the feedback signals from the displacement sensor 15, the flow sensor 16, and the temperature and pressure sensor 22 are processed, analyzed, and controlled by the PLC controller 21, and the monitoring results are transmitted to the main control center to issue a warning signal. At this time, the PLC controller 21 controls the upper electromagnetic suction module and the lower electromagnetic suction module to switch on, the central flow tube 7 overcomes the preload of the spring 5 under the magnetic attraction of the upper electromagnetic suction module and the lower electromagnetic suction module, while driving the protrusion 702 on the central flow tube 7 to push the guide sleeve 18 to move axially. The guide block 1802 on the guide sleeve 18 moves axially and leaves the locking sleeve 19. The guide inclined surface 1801 drives the inclined slot 703 on the central flow tube 7 to move to the sliding slot 1902, and the thrust bearing 6 rotates at a certain angle with the movement of the guide sleeve 18. Finally, the guide inclined surface 1801 drives the inclined slot 703 on the center flow tube 7 to move to the top of the sliding slot 1902, at this moment, the subsurface safety valve changes from an open state to a closed state.

The above are merely preferred embodiments of the present invention and are not intended to limit the present invention. The present invention may be subject to changes and variations for those skilled in the art. Any modifications, equivalent replacements, and improvements made within the spirit and principles of the present invention shall all be encompassed in the protection scope of the present invention.

The invention claimed is:

1. A fully electrically controlled intelligent subsurface safety valve, comprising an external component, a magnetic excitation switch, an upper electromagnetic suction module, a lower electromagnetic suction module, and a rebound flap valve mechanism, wherein the external component is composed of an upper joint, a lower joint, a valve shell, a flow sensor, a power communication composite cable connector, a sealing cover, a PLC controller, and a temperature and pressure sensor; the magnetic switch is composed of a magnetic piston ring, a spring, a thrust bearing, a central flow tube, a guide sleeve and a locking sleeve; the upper electromagnetic suction module and the lower electromagnetic suction module are both composed of a magnetic isolation collar, an annular wire rack, a annular iron core, a circular coil, and an outer sleeve; and the rebound flap valve mechanism is composed of a valve seat, a plate valve, and a displacement sensor; wherein the upper joint is connected to the valve shell through threads, the valve shell is provided with a first valve shell through hole, a second valve shell through hole, a first step, and a second step; the central flow pipe is arranged between the upper joint and the plate valve, the locking sleeve is connected to the upper joint through threads, the guide sleeve is arranged between the locking sleeve and the central flow pipe, the upper electromagnetic suction module is arranged between the upper joint and the first step, the magnetic piston ring is connected with the central flow pipe through threads, the magnetic piston ring is matched with the valve shell in a clearance fit, the spring is arranged between the central flow pipe and the valve seat, the lower electromagnetic suction module is arranged between the second step and the valve seat, the valve seat is connected with the valve shell through threads, the lower joint is connected with the valve shell through threads, the displacement sensor is provided on the plate valve, the flow sensor is provided on an inner wall of the lower joint, and the temperature and pressure sensor is arranged inside the lower joint.

2. The fully electrically controlled intelligent subsurface safety valve according to claim 1, wherein a plurality of first electrical connection holes are circumferentially distributed on an upper end of the upper joint uniformly, the power communication composite cable connector is arranged in the first electrical connection holes, and the upper electromagnetic suction module, the lower electromagnetic suction module, the displacement sensor, the flow sensor, and the temperature and pressure sensor are all electrically connected through the power communication composite cable connector.

3. The fully electrically controlled intelligent subsurface safety valve according to claim 1, wherein an inner wall of the upper joint is provided with a guide groove, a first through hole, and a first groove, the PLC controller is arranged in the first groove and a power supply line of the PLC controller passes through the first through hole, and the sealing cover is covered and arranged on the upper joint through the guide groove.

4. The fully electrically controlled intelligent subsurface safety valve according to claim 1, wherein a second electrical connection hole, a first sealing groove, and a second through hole are circumferentially distributed at the lower end of the lower joint uniformly, a power supply line of the displacement sensor passes through the second through hole, and a plurality of the flow sensors are arranged circumferentially on the inner wall of the lower joint uniformly.

5. The fully electrically controlled intelligent subsurface safety valve according to claim 1, wherein power supply lines of the upper electromagnetic suction module and the lower electromagnetic suction module respectively pass through the first valve shell through hole and the second valve shell through hole.

6. The fully electrically controlled intelligent subsurface safety valve according to claim 1, wherein an upper part of the central flow pipe is provided with a second sealing groove, a middle part is circumferentially distributed with protrusions and inclined slots uniformly, and a lower part is provided with a third step.

7. The fully electrically controlled intelligent subsurface safety valve according to claim 1, wherein the guide sleeve is provided with guide inclined surfaces, guide blocks, and a second groove, and the thrust bearing is arranged in the second groove.

8. The fully electrically controlled intelligent subsurface safety valve according to claim 1, wherein the locking sleeve is provided with locking inclined surfaces and sliding slots.

* * * * *